US009452454B2

(12) United States Patent
Taneda et al.

(10) Patent No.: US 9,452,454 B2
(45) Date of Patent: Sep. 27, 2016

(54) DRY TYPE CLEANING HOUSING AND DRY TYPE CLEANING APPARATUS

(71) Applicants: Yuusuke Taneda, Kanagawa (JP); Yoichi Okamoto, Kanagawa (JP); Akihiro Fuchigami, Kanagawa (JP); Kohji Tsukahara, Kanagawa (JP); Shozo Murata, Kanagawa (JP)

(72) Inventors: Yuusuke Taneda, Kanagawa (JP); Yoichi Okamoto, Kanagawa (JP); Akihiro Fuchigami, Kanagawa (JP); Kohji Tsukahara, Kanagawa (JP); Shozo Murata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 965 days.

(21) Appl. No.: 13/706,740

(22) Filed: Dec. 6, 2012

(65) Prior Publication Data

US 2013/0180552 A1 Jul. 18, 2013

(30) Foreign Application Priority Data

Dec. 12, 2011 (JP) ..... 2011-271524

(51) Int. Cl.

| | |
|---|---|
| ***B08B 7/02*** | (2006.01) |
| ***B08B 5/02*** | (2006.01) |
| ***B08B 15/04*** | (2006.01) |
| ***B24C 1/04*** | (2006.01) |

(52) U.S. Cl.

CPC . *B08B 5/02* (2013.01); *B08B 7/02* (2013.01); *B08B 15/04* (2013.01); *B24C 1/04* (2013.01)

(58) Field of Classification Search

CPC ..... B08B 5/02; B08B 5/04; B08B 7/02; B08B 7/04; B24C 7/0038; B24C 7/0046; B24C 7/0053; B24C 7/0061; B24C 7/0069

See application file for complete search history.

(56) References Cited

U.S. PATENT DOCUMENTS

| | | | | |
|---|---|---|---|---|
| 4,884,314 | A | 12/1989 | Miner et al. | |
| 5,800,679 | A * | 9/1998 | Lindstrom | B08B 5/026 134/64 R |
| 7,047,984 | B2 * | 5/2006 | Blattner | G03F 1/82 134/1 |
| 7,552,503 | B2 * | 6/2009 | Wakao | B08B 3/02 134/1 |
| 7,743,776 | B2 | 6/2010 | Okamoto et al. | |
| 7,758,700 | B2 | 7/2010 | Fuchigami et al. | |
| 7,854,648 | B2 | 12/2010 | Satoh et al. | |

(Continued)

FOREIGN PATENT DOCUMENTS

| | | |
|---|---|---|
| JP | 59-183231 | 10/1984 |
| JP | 60-188123 | 9/1985 |

(Continued)

OTHER PUBLICATIONS

Japanese official action dated Aug. 18, 2015 in corresponding Japanese Patent Application No. 2011-271524.

*Primary Examiner* — Timothy V Eley
(74) *Attorney, Agent, or Firm* — Cooper & Dunham LLP

(57) ABSTRACT

A dry type cleaning housing which causes a cleaning medium to fly with an air flow and places the cleaning medium on a cleaning object to clean the cleaning object is disclosed. The dry type cleaning housing includes an inner space which causes the cleaning medium to fly; an opening which abuts the cleaning medium against the cleaning object to collide the cleaning medium with the cleaning object; a ventilation path which passes air from outside into the inner space; a suction opening which suctions the air introduced into the inner space via the ventilation path to generate a revolving air flow in the inner space; a porous unit which passes removed matter removed from the cleaning object to the suction opening side; and a revolving air flow adjusting unit which arbitrarily reduces or stops the revolving air flow.

12 Claims, 12 Drawing Sheets

(56) References Cited

U.S. PATENT DOCUMENTS

| | | | |
|---|---|---|---|
| 2007/0107752 | A1 | 5/2007 | Fuchigami et al. |
| 2008/0052953 | A1 | 3/2008 | Okamoto et al. |
| 2009/0314312 | A1 | 12/2009 | Fuchigami et al. |
| 2010/0307535 | A1 | 12/2010 | Fuchigami et al. |
| 2011/0067731 | A1 | 3/2011 | Satoh et al. |
| 2012/0117749 | A1 | 5/2012 | Fuchigami et al. |
| 2012/0216363 | A1 | 8/2012 | Okamoto et al. |
| 2012/0225613 | A1 | 9/2012 | Fuchigami et al. |

FOREIGN PATENT DOCUMENTS

| | | |
|---|---|---|
| JP | 3-501814 | 4/1991 |
| JP | 4-83567 | 3/1992 |
| JP | 7-8846 | 4/1995 |
| JP | 2001-174017 | 6/2001 |
| JP | 2007-29945 | 2/2007 |
| JP | 2009-226394 | 10/2009 |
| JP | 2010-22898 | 2/2010 |
| JP | 2010-175687 | 8/2010 |
| JP | 2011-101853 | 5/2011 |

* cited by examiner

DRY TYPE CLEANING HOUSING AND DRY TYPE CLEANING APPARATUS

TECHNICAL FIELD

The present invention relates to a dry type cleaning apparatus which cleans an object to be cleaned also called "a cleaning object" below) by causing a flying cleaning medium to be in contact with (including a concept of collision) the cleaning object, and more particularly to a dry type cleaning apparatus that can clean the cleaning object by placing on an arbitrary part of the cleaning object and that is particularly preferable as a handy type apparatus, and a dry type cleaning housing used for the dry type cleaning apparatus.

The present invention is used in removing flux affixed to a mask jig called a dip palette or a carrier palette that is used in a flow soldering tank process, for example, and is particularly suitable for removing flux fixed to a narrow region such as a side face of the cleaning object, a periphery of an opening, etc.

BACKGROUND ART

In recent years, in a soldering process by a flow soldering tank in printed-circuit board manufacturing, a jig for masking a region other than a region to solder on is frequently used. Since repetitively using such a mask jig (called the dip palette or the carrier palette) causes flux to be accumulated and fixed onto a surface, decreasing an accuracy of the mask, it is necessary to perform cleaning periodically.

In general, as such cleaning is performed by dipping in a solvent, consuming a large amount of solvent, a cost increase is inevitable and a burden on an operator is also quite large.

A known method of spraying the solvent onto the cleaning object in an apparatus without dipping also uses a large amount of solvent.

As a technique for overcoming this problem, a dry type cleaning apparatus is known which cleans a cleaning object by causing a flying cleaning medium to be in contact therewith.

Patent documents 1 and 2 disclose a cleaning method, wherein an opening is provided on a side face of a cylindrically-shaped container, a cleaning medium is caused to fly in a circumferential direction in the container with a revolving air flow formed by a compressed air flow, to cause the cleaning medium to collide with the cleaning object which is in contact with the opening.

However, with this method, the revolving air flow is formed by the compressed gas flow, so that a problem can not be avoided that the cleaning medium leaks out of the container when the cleaning object is separated from the opening.

In order to overcome this problem, in Patent document 1, a net member is provided at the opening to prevent the leakage. However, new problems arise such as energy decreasing when the cleaning medium collides with the cleaning object, and cleaning capabilities decreasing due to the cleaning medium getting caught in the net member.

In Patent document 2, which discloses providing an opening and closing lid which blocks an opening to prevent leakage, it is necessary to perform blocking by quickly moving the opening and closing lid when a cleaning object is separated from the opening, so that there are problems that an operator is compelled to provide unnecessary attention and efforts and that, the mechanism is complex, is difficult to operate, and is susceptible to failures.

In view of the circumstances as described above, the applicant of the present application has proposed a dry type cleaning apparatus, wherein a cleaning medium in a form of thin flakes is caused to fly with a revolving air flow generated by an air flow which flows from outside of a housing to inside thereof via a ventilation path (an inlet) while a suction unit is connected to the housing and an opening is blocked by the cleaning object, and wherein gas and dust are permitted to pass within the housing while not allowing the cleaning medium to pass therethrough (for example, a mesh-shaped porous unit being provided therein causes the cleaning medium to stay in a revolving air flow forming region, causing the cleaning medium to continuously fly and circulate with the revolving air flow (Japanese Patent Application No. 2010-175687 (below called "a prior application technique"))).

According to this dry type cleaning apparatus, even if the cleaning object is separated from the opening, the same level as the atmospheric pressure is reached in the ventilation path, the revolving air flow vanishes, and also a large amount of outer air flows into the housing from the opening due to negative pressure caused by suction, so that the cleaning medium within the housing is suctioned to the porous unit and stays within the housing, causing no leakage from the opening.

PATENT DOCUMENTS

Patent document 1 JP4-83567A

Patent document 2: JP60-188123

In the cleaning housing in which the revolving air flow is generated therein, as described above, even if the opening and the cleaning object are separated, as an amount of air which flows thereinto from the opening is large, the cleaning medium is suctioned to the porous unit and stays within the housing.

However, in an actual cleaning process, the cleaning medium may leak out from the opening or the inlet at a time of release or at a time of non-cleaning at which the cleaning object is separated from the opening.

This is because at the time of release or at the time of non-cleaning, even if a large amount of outer air flows into the housing from the opening, the revolving air flow and a reverse revolving air flow are generated within the housing, so that a force with which the cleaning medium lies exceeds a force with which the cleaning medium is suctioned to the porous unit.

This leakage phenomenon, which also depends on a shape of the cleaning medium, markedly appears in a small cleaning medium which is formed closer to a grain shape than to a large area.

DISCLOSURE OF THE INVENTION

In view of the circumstances as described above, a main object of the present invention is to provide a dry type cleaning housing which may accurately prevent leakage of a cleaning medium at a time of release or at a time of non-cleaning regardless of a shape of the cleaning medium.

Definitions of terms in the present specification are as follows:

A "housing" in the present invention is a container-shaped structure which is provided with a space which is shaped such that a revolving air flow may easily be generated therein. A shape such that the revolving air flow may easily be generated is a shape having a continuous inner wall, along which inner wall of the housing an air flow can flow and circulate and is, more desirably, a shape having an inner wall or an internal space with a rotating body shape.

A "ventilation path", which is a unit which facilitates the air flow to flow in a certain direction, typically has a shape of a tube with a smooth inner face. However, the ventilation path is to also include a form which uses a plate-shaped flow path control plate, etc., having a smooth face, for example, since such a plate expresses a rectifying effect which facilitates gas to flow in a direction along the face thereof.

Moreover, it is typical to have a shape such that the air flow flows linearly. However, the rectifying effect can still be obtained even if it has a gradual curve, which does not produce much flow path resistance. Unless specifically stated, a direction of the ventilation path means a direction in which the gas flow blows out at an air flow entrance.

In the present invention, the ventilation path, which has a tube shape, which one end is connected to the air flow entrance on the inner wall of the housing, and which other end is an air intake opening that is open to atmosphere outside the housing, is called an "inlet" since such a plate expresses a rectifying effect such that it facilitates air to flow in a direction along the face thereof. The inlet typically has a low fluid resistance, has a smooth inner face, and, for a cross section of the tube thereof, circular, rectangular, slit shapes, etc., are used.

In the present invention, for a "revolving gas flow", a gas flow accelerated by a gas flow flowing in from the air flow entrance flows along the inner wall of the housing by changing a direction thereof, circulates back to a position of the air flow entrance, and merges with the gas flow flowing in. If a fluid which forms the gas flow is air, it is synonymous with a "revolving air flow". Typically, it is generated within a closed space with a continuous inner wall, by causing a gas flow to flow in a tangent line direction of the inner wall. The object of the present invention is to perform restoring operations at a proper timing while reducing the number of times of restoring operations to improve throughput.

According to an embodiment of the present invention, a dry type cleaning housing which causes a cleaning medium to fly with an air flow and places the cleaning medium on a cleaning object to clean the cleaning object is provided, including: an inner space which causes the cleaning medium to fly; an opening which abuts the cleaning medium against the cleaning object to collide the cleaning medium with the cleaning object; a ventilation path which passes air from outside into the inner space; a suction opening which suctions the air introduced into the inner space via the ventilation path to generate a revolving air flow in the inner space; a porous unit which passes removed matter removed from the cleaning object to the suction opening side; and a revolving air flow adjusting unit which arbitrarily reduces or stops the revolving air flow.

Embodiments of the present invention make it possible to ensure preventing leakage of a cleaning medium out of a housing from therein at a time of release or at a time of non-cleaning, at which time a cleaning object and the housing are separated.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

A description is given below, with reference to the drawings, of embodiments of the present invention.

First, with reference to FIGS. 10A through 12, a description is given of a basic configuration and functions of a handy-type dry type cleaning apparatus according to the above-described prior application technique used as a basis of the present invention.

Figure 10A:
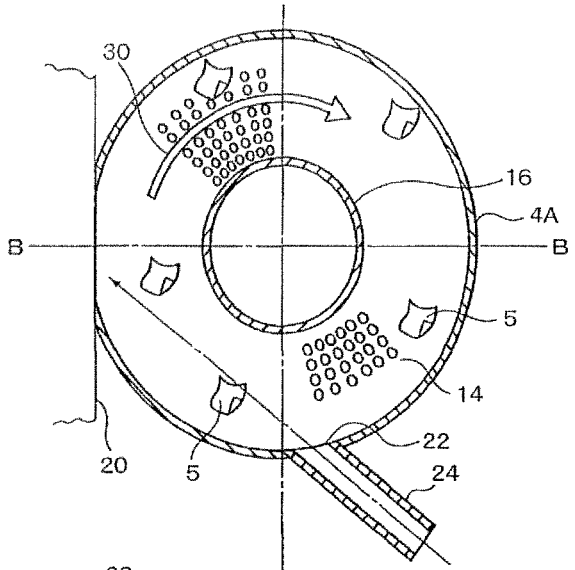
FIGS. 10A and 10B are schematic sectional views illustrating a basic configuration of the dry type cleaning apparatus of the present invention.
Figure 10B:
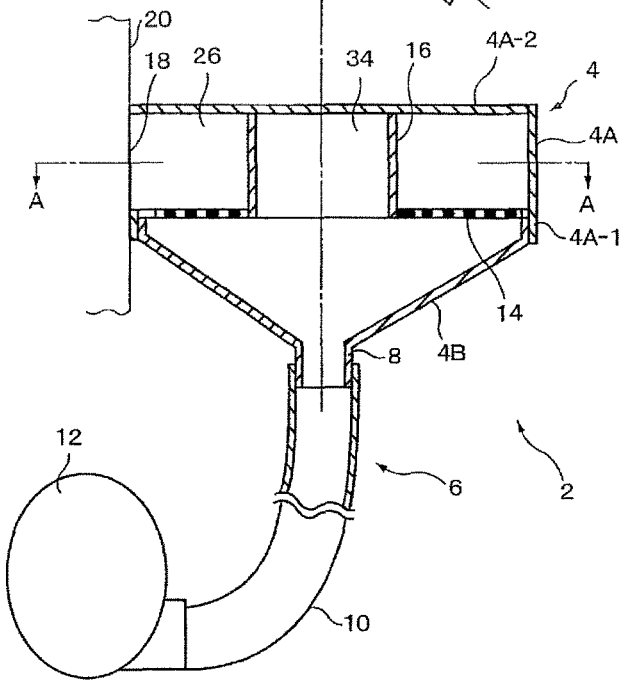

Based on FIGS. 10A and 10B, a description is given of an overview of a configuration of a handy-type dry type cleaning apparatus 2. FIG. 10A is a horizontal sectional view cut along a line A-A, while FIG. 10B is a vertical sectional view cut along a line B-B.

The dry type cleaning apparatus 2 includes therein a dry type cleaning housing 4 (below called merely a "housing") having a flying space for a cleaning medium 5, and a suction unit 6 which turns a pressure within the housing 4 into a negative pressure.

The housing 4 is integrally made up of an upper housing 4A having a cylindrical shape as a housing body, and a lower housing 4B having an inverted cone shape. The upper and lower housings, which are names on the drawings for convenience, do not necessarily correspond to upper and lower portions on an actual apparatus.

The lower housing 4B, which has integrally provided therewith a suction opening 8 at an apex of the cone thereof, functions as a suction duct.

The suction unit 6 includes a flexible suction hose 10 having one end thereof connected to the suction opening 8 and a suction apparatus 12 connected to the other end of the suction hose 10. As the suction apparatus 12, a home vacuum cleaner, a vacuum motor, a vacuum pump, an apparatus which indirectly produces low pressure or negative pressure by sending a fluid by pressure, etc., may be used appropriately. Vertical positional relationships such as a top face, a bottom face of a member, etc., are merely references on the drawings.

The bottom face of the upper housing 4A is a fit concave portion 4A-1 which joins therewith an upper end of the lower housing 4B, and the upper housing 4A and the lower housing 4B are separable. A top face 4A-2 of the upper housing 4A is sealed.

At a boundary portion with the lower housing 48 at the bottom face of the upper housing 4A, a porous separating plate 14 as a porous unit is provided. The separating plate 14 is a plate-shaped member with holes like a punching metal. The separating plate 14 prevents the cleaning medium 5 from moving to the lower housing 4B side when it is suctioned. In FIG. 10A, the separating plate 14 is partly not shown. The cleaning medium 5 is shown in an exaggerated manner with respect to a size thereof in order to facilitate understanding.

The porous unit may have any porous shape as long as it has a large number of pores with a size such as to pass through air and dust (removed matter, which is removed from the cleaning object) but not the cleaning medium 5, so that a slit plate, a net, etc., may be used, and resin, metal, etc., may be freely selected as a material for the porous unit as long as it has a smooth face.

The porous unit is arranged as a face which is orthogonal to a revolving axis of the revolving air flow. This causes an air flow to flow in a direction along the porous unit, leading to an advantageous effect of preventing the cleaning medium 5 from being accumulated thereon.

In order to suppress attenuation of the revolving air flow, an inner face of the housing is desirably smooth without any step or irregularity.

The porous unit, by being arranged on a face along the revolving air flow, makes it possible to cause the cleaning medium suctioned onto the surface thereof to fly again.

For a material for the housing 4, which is not particularly limited, in order to prevent attrition due to friction with the cleaning medium and foreign matter adhering thereto, while a metal such as aluminum, stainless steel, etc., is preferable, for example, a resin material may also be used.

At a center inside the upper housing 4A is provided a cylindrically-shaped flow path restricting member 16 as a part of the housing such that a cylindrical axis of the upper housing 4A is made to be a common axis, and a lower end of the flow path restricting member 16 is fixed to the separating plate 14.

The flow path restricting member 16 is provided for a purpose of increasing a flow speed by restricting a flow path cross-sectional area of the revolving air flow. With the flow path restricting member 16, a ring-shaped revolving air flow moving space (cleaning medium flying space) having a smooth wall face is formed within the upper housing 4A.

Depending on a shape of the upper housing 4A, it is not necessary to make a central axis of the flow path restricting member 16 and a central axis of the upper housing 4A common, so that the axis may be eccentric as long as a ring-shaped space is secured.

On a part of a side face of the upper housing 4A is formed an opening 18 for causing the cleaning medium 5 flying with the revolving air flow to be in contact with or to collide with the cleaning object.

The upper housing 4A has a shape of a cylinder with a height which is significantly low relative to a diameter and the opening 18 is provided at a portion of a side face which forms a height thereof, leading to a layout as the whole housing 4 such that, as shown in FIG. 10B, an outer peripheral portion thereof other than the opening 18 is located significantly away from a cleaning object 20, so that a degree of freedom of local abutment against the cleaning object 20, or, in other words, a degree of freedom of pin-point cleaning is enhanced.

The opening 18, which has a shape such that a side face of the upper housing 4A is cut through a flat cross section which is parallel to a cylindrical axis, has formed a rectangular shape as viewed from a direction which is orthogonal to the cylindrical axis.

On the side surface of the upper housing 4A is formed an air flow entrance 22, in which an inlet 24 as a revolving air flow generating unit and a ventilation path is connected from outside the upper housing 4A and integrally fixed to the upper housing 4A.

The inlet 24 is set generally parallel to the separating plate 14, a ventilation direction of which inlet 24 is tilted relative to a radial direction of the upper housing 4A, and is positioned such that a line extending from a center of the ventilation path thereof reaches the opening 18.

The inlet 24 has a width which extends in a height direction of the upper housing 4A. The inlet 24 may be one inlet with a diameter or a width which is smaller than a height of the upper housing 4A, or it may be configured to arrange a unit inlet in multiple numbers in the height direction.

As shown in FIGS. 10A and 10B, when the opening 18 is blocked by abutting against the cleaning object 20, the inside of the housing 4 becomes a closed space, so that outer air flows thereinto from the inlet 24 at high speed, and this high speed air flow accelerates the cleaning medium 5 towards the opening 18 and generates a revolving air flow 30 as a revolving air flow.

The revolving air flow, which is generated when the closed space is formed, blows the cleaning medium suctioned onto the separating plate 14 to cause the cleaning medium 5 to fly again.

The opening 18 has an area which is sufficiently large for making an internal pressure at the air flow entrance 22 the same as or close to the atmospheric pressure when the opening 18 is opened. Moreover, the airflow entrance 22 is also arranged at a position which is easy to make it the same as or close to the atmospheric pressure when the opening 18 is opened.

Such a configuration leads to a decreased difference in pressure with outside as the pressure at the air flow entrance 22 approaches the atmospheric pressure during the time the dry type cleaning apparatus 2 is not placed on the cleaning object. As a result, the air flow flowing in decreases dramatically. On the other hand, the air flow flowing in from the opening 18 increases, making it possible to prevent the cleaning medium 5 from leaking out of the housing 4.

Moreover, as a total amount of air flow which flows in when the opening 18 is opened becomes two to three times relative to that when the opening 18 is blocked, the cleaning medium 5 in a thin flake form in particular is suctioned onto the porous unit, so that neither re-flying, nor leaking out of the housing occurs. This is called a cleaning medium suction effect at a time the opening is open.

The cleaning medium 5, which is a collection of thin-flake shaped cleaning pieces, is also referred to here as a single thin-flake shaped cleaning piece.

A thin-flake shaped cleaning medium is a thin flake with an area between 1 $mm^2$ and 200 $mm^2$. Moreover, a material for the cleaning medium is a film made of a durable material such as polycarbonate, polyethylene terephthalate, acryl, a cellulose resin, etc., with a thickness of between 0.02 mm and 1.0 mm.

Depending on the cleaning object, a thickness, a size, or a material of the cleaning medium may be varied effectively. Using such a cleaning medium with the varied thickness, size, or material is also included in the scope of the present invention, so that the cleaning medium conditions are not to be constrained thereto.

The material for the cleaning medium is not limited to resin only, so that a thin flake made of paper, cloth, etc., may be used or, alternatively, a mineral such as mica, ceramics, glass, and metal foil may be used as long as the material is made into a thin, light, and easy-to-fly form.

The ring-shaped internal space 26 of the upper housing 4A is a space which serves a function of causing the cleaning medium 5 to fly with the revolving air flow and to be in contact with the cleaning object 20 opposing the opening 18.

An internal space 34 of the flow path restricting member 16 is a space in which the revolving air flow does not act.

Figure 11A:
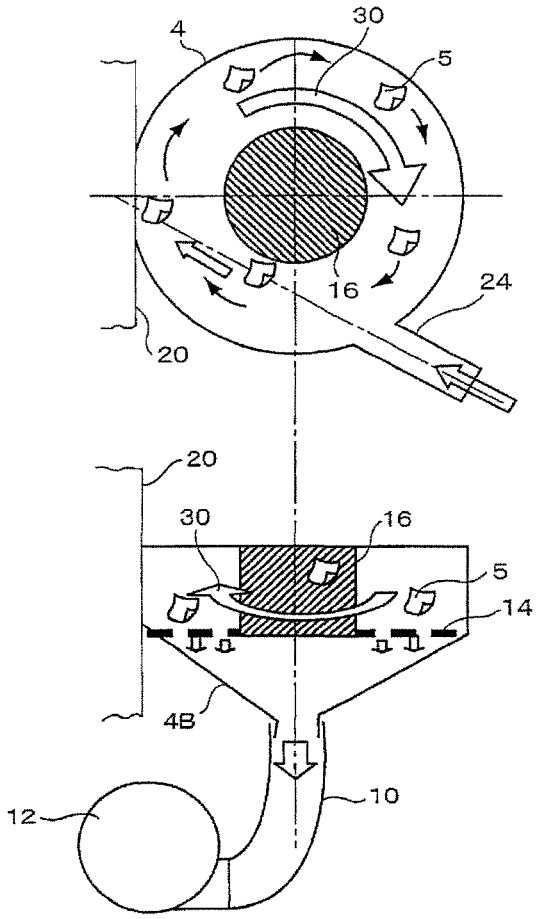
FIGS. 11A and 11B are diagrams illustrating a cleaning operation of the dry type cleaning apparatus of the present invention.
Figure 11B:
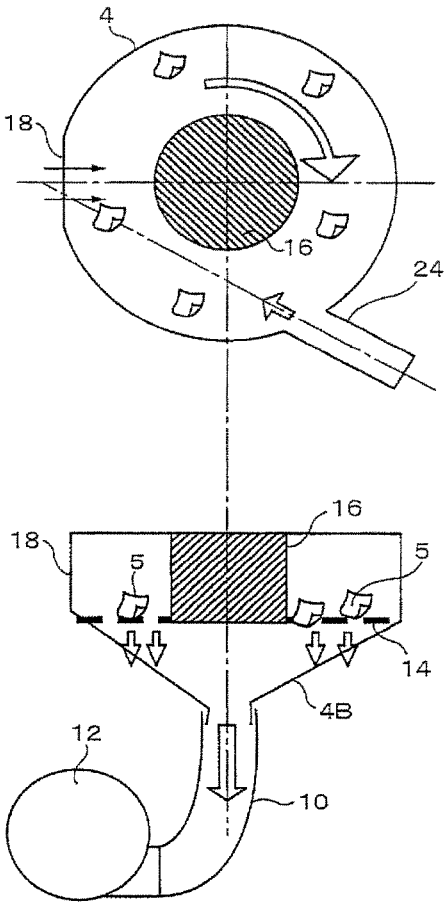

A cleaning operation by the dry type cleaning apparatus 2 which is configured as described above (below called the cleaning operation) is described with reference to FIGS. 11A and 11B. In FIGS. 11A and 11B, a thickness, etc., of a member is omitted, and, for ease of understanding, the internal space 34 as a still space is illustrated by hatching.

FIG. 11B illustrates a state in which the opening 18 is separated from the cleaning object 20, opening the opening 18 and performing suction, while FIG. 11A illustrates a state in which the opening 18 is placed on the cleaning object 20 to block the opening 18.

Prior to the cleaning operation, the cleaning medium 5 is supplied into the housing 4. As shown in the bottom diagram of FIG. 11B, the cleaning medium 5 supplied into the housing 4 is suctioned to the separating plate 14 to be held within the housing 4.

As the inside of the housing 4 is in a negative pressure state due to suction, air outside the housing flows into the housing 4 through the inlet 24, at which time the flow speed and the flow rate of the flow within the inlet 24 are low, so that the revolving air flow 30 generated within the housing 4 is not strong enough to cause the cleaning medium 5 to fly.

When the cleaning medium 5 is supplied into and held in the housing 4, as shown in FIG. 11A the opening 18 is placed on a part to be cleaned on a surface of the cleaning object 20 to block the opening 18.

When opening 18 is blocked, the suction from the opening 18 stops, so that the negative pressure within the housing 4 rapidly increases, the amount and speed of the air suctioned through the inlet 24 increase, the air is rectified in the inlet 24, and a high speed air flow blows out of an inlet exit (an air flow entrance 22) into the housing 4.

The air flow blown out causes the cleaning medium 5 held on the separating plate 14 to fly towards a surface of the cleaning object 20 opposing the opening 18.

While the above-described air flow becomes the revolving air flow 30, and flows in a ring shape along the inner wall of the housing 4, a part of the revolving air flow 30 passes through the holes of the separating plate 14 to be suctioned by the suction unit 6.

In this way, when the revolving air flow 30 which flew in the ring shape within the housing 4 returns to an exit of the inlet 24, the air flow entering from the inlet 24 accelerates while merging with the revolving air flow 30. In this manner, the revolving air flow 30 is stably formed inside the housing 4.

The cleaning medium 5 revolves within the housing 4 with the revolving air flow, and repeatedly collides with a surface of the cleaning object 20. An impact due to the collision causes the dirt to separate from the surface of the cleaning object 20 as microscopic grains or powder.

The separated dirt passes through the holes of the separating plate 14, and is discharged out of the housing 4 by the suction unit 6.

The revolving air flow 30 formed within the housing 4, which has a revolving axis thereof orthogonal to the surface of the separating plate 14, becomes an air flow which is parallel to the surface of the separating plate 14.

Thus, the revolving air flow 30 blows against the cleaning medium 5 suctioned to the surface of the separating plate 14 from a lateral direction to enter between the cleaning medium 5 and the separating plate 14, causing an effect of peeling off the cleaning medium 5, which is suctioned to the separating plate 14, from the separating plate 14, to cause the cleaning medium 5 to fly again.

Moreover, the opening 18 is blocked to increase the negative pressure within the upper housing 4A, approaching the negative pressure inside the lower housing 4B, so that a force which suctions the cleaning medium 5 onto the surface of the separating plate 14 also decreases, causing an effect that the cleaning medium 5 can fly more easily.

For the revolving air flow 30, as the air flow is accelerated in a certain direction, it is likely to be generated at high speed, so that a high speed flying movement of the cleaning medium 5 is also facilitated. The cleaning medium 5 which undergoes a revolving movement at high speed is unlikely to be auctioned to the separating plate 14, so that the dirt affixed to the cleaning medium 5 is easily separated from the cleaning medium 5 due to a centrifugal force.

Figure 12:
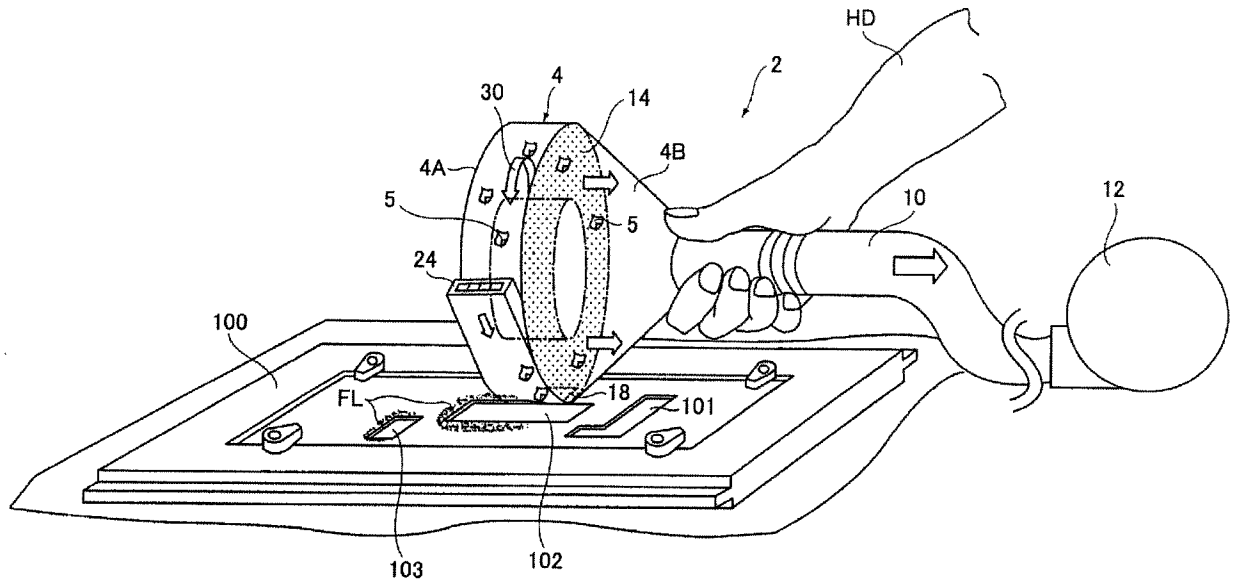
FIG. 12 is an oblique view illustrating a usage state of the dry type cleaning apparatus of the present invention.

FIG. 12 illustrates an actual example of cleaning by the above-described dry type cleaning apparatus 2.

The cleaning object, which is a dip palette used in the flow soldering tank process described above, is shown with a letter 100.

The dip palette 100 has mask openings 101, 102, and 103, which are opened, around holes of which mask openings flux FL is accumulated and solidified. The accumulated and solidified flux FL is the dirt to be removed.

As shown in FIG. 12, a root part (a part of the suction opening 8) of the lower housing 4B is held by a hand HD, and, in a suction state, the opening 18 of the housing 4 is pushed against the cleaning part.

As the inside of the housing 4 is in a suction state and the cleaning medium 5 is suctioned against the separating plate before the opening 18 is pushed against the cleaning part, the cleaning medium 5 does not leak out from inside the housing 4 even though the opening 18 faces downwards.

Of course, after the opening 18 is pushed against the cleaning part, inside the housing becomes airtight, so that leaking out of the cleaning medium does not occur.

When the opening 18 is pushed against the cleaning part, the air flow flowing in through the inlet 24 rapidly increases, a strong revolving air flow 30 to be generated within the housing 4, causing the cleaning medium 5 suctioned to the separating plate 14 to fly and collide with the flux FL that is affixed to/solidified at the cleaning part of the dip palette 100 to remove the flux FL.

As described above, the cleaning operator may hold a root part of the lower housing 4B with his hand HD, conduct a movement relative to the dip palette 100 to sequentially move the cleaning respective parts to remove the whole affixed/solidified flux FL.

In the state illustrated in FIG. 12, parts around the mask opening 101 of the dip palette 100 have been cleaned, while parts around the mask openings 102 and 103 are being cleaned.

Even though the opening 18 is separated from the cleaning part when moving the opening to the cleaning part, due to the above-described cleaning medium suction effect, as the cleaning medium 5 does not leak out from inside the housing, the number of the cleaning media is maintained, so that the cleaning performance does not decrease due to a reduction in the amount of the cleaning medium.

While being used repeated cleaning medium 5 is gradually destroyed due to an impact by colliding with the cleaning part, and is suctioned and collected by the suction apparatus 12 together with the flux (dirt) removed from the dip palette 100 of the cleaning part, so that, while using the dry type cleaning apparatus for a long time, the amount of the cleaning medium held in the housing decreases.

In such a case, a group of new cleaning media is replenished within the housing 4.

With reference to FIGS. 1A through 5B, a first embodiment of the present invention is described. The same parts as the basic configuration described above are shown with the same letters where appropriate. Moreover, principles of flying of the cleaning apparatus and the cleaning medium are the same as the above-described basic configuration and a method of use as a dry type cleaning apparatus is also the same, so that an overall configuration as the dry type cleaning apparatus is omitted.

A dry type cleaning housing 40 according to the present embodiment is a configuration such that the above-described basic configuration is made into a further compact size by sucking in from both sides in the revolving axis direction.

Figure 2:
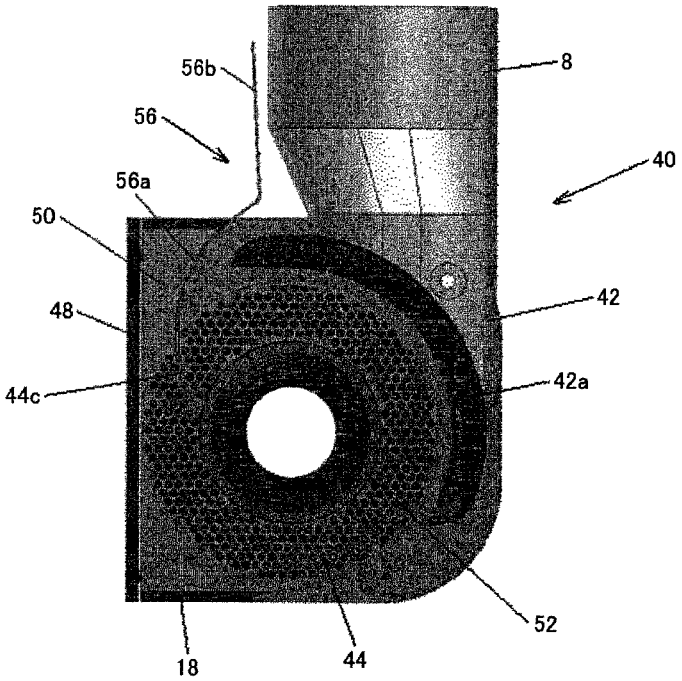
FIG. 2 is a perspective side view of the dry type cleaning housing according to the first embodiment of the present invention.
Figure 3:
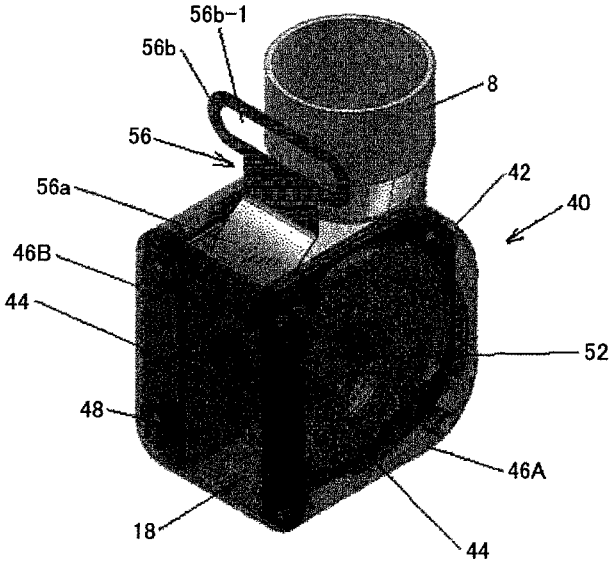
FIG. 3 is a perspective oblique view of the dry type cleaning housing according to the first embodiment of the present invention.
Figure 4:
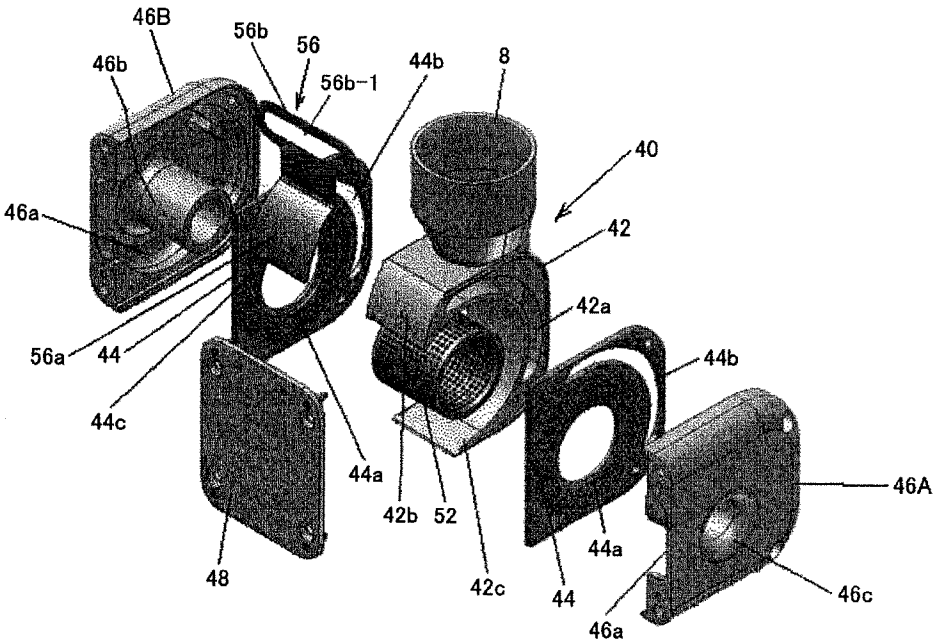
FIG. 4 is an exploded oblique view of the dry type cleaning housing according to the first embodiment of the present invention.

As shown in FIGS. 2 to 4, the dry type cleaning housing 40 includes a housing body 42; a suction opening 8 which is integrally formed at an upper portion of the housing body 42; suction covers 46A and 46B as side faces in the revolving axis direction that are arranged on both sides in the revolving axis direction of the housing body 42 to place a separating plate 44 therebetween; a front cover 48 as an outside face; a cylindrically-shaped flow path restricting member 52 which is arranged inside the housing body 42 and which defines a revolving axis; an inlet 50 which is formed on the front cover 48 at an upper portion of the housing body 42; a revolving air flow adjusting plate 56 as a revolving air flow adjusting unit which is provided in a region of the inlet 50, etc. The dry type cleaning apparatus is configured such that the suction hose 10 is connected to the suction opening 8.

At the housing body 42, an arc-shaped suction path 42*a* which communicatively connects to the suction opening 8 is formed, penetrating therethrough in the revolving axis direction. An upper face tip 42*b* of the housing body 42, which forms a part of the inlet 50, is formed in a smooth curved face shape such that air resistance is reduced. A lower face tip 42*c* of the housing body 42 defines one side of the opening 18.

The respective separating plates 44 include an arc-shaped opening 44*b* which communicatively connects to the suction path 42*a* as well as a supporting hole 44*a* which supports the flow path restricting member 52 at a central portion thereof.

The suction covers 46A and 460 include an air gap portion 46*a* which communicatively connects to the suction path 42*a* via the opening 44*b*.

At the suction cover 46B is formed a cylindrically-shaped supporting convex portion 46*b* which is inserted into the flow path restricting member 52, while an inserting hole 46*c* of the supporting convex portion 46*b* is formed at the suction cover 46A.

The suction covers 46A and 46B, and the separating plate 44 are integrally fixed to the housing body 42 with a screw, while the front cover 48 is fixed to the suction covers 46A and 46B with a screw.

In the same manner as the separating plate 44, the flow path restricting member 52 has a porous structure.

As shown in FIG. 4, the revolving air flow adjusting plate 56 includes a flow path blocking portion 56*a* which has a shape of an arc along a curved face of the upper face tip 42*b* which makes up the inlet 50; and a pinching portion 56*b* which moves the flow path blocking portion 56*a*. At the pinching portion 56*b* is formed a finger penetrating hole 56*b*-1 for facilitating a picking up operation.

On an inner face of the respective separating plates 44 is formed an arc-shaped guide groove 44*c* which guides the flow path blocking portion 56*a*.

A material for the revolving air flow adjusting plate 56 is not particularly limited as long as at least the flow path blocking portion 56*a* withstands collision of the cleaning medium and suction pressure inside the flow path. For decreasing weight, a resin plate or a metal thin plate is normally used. As the flow path cannot be blocked completely when the cleaning medium is placed therein, a portion which comes into contact with the flow path restricting member or the housing is preferably coated with a significantly deformed rubber member. (The same applies to other embodiments below.)

Figure 1B:
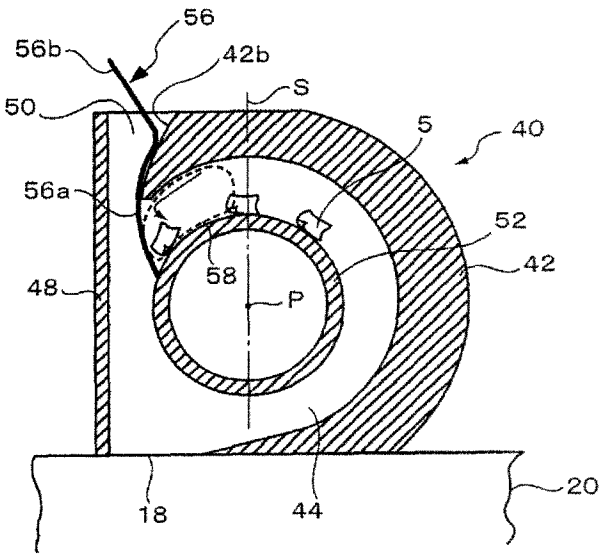
FIG. 1B is a view illustrating a state in which a revolving air flow is stopped in the set of schematic vertical sectional views illustrating the dry type cleaning housing according to the first embodiment of the present invention.
Figure 1A:
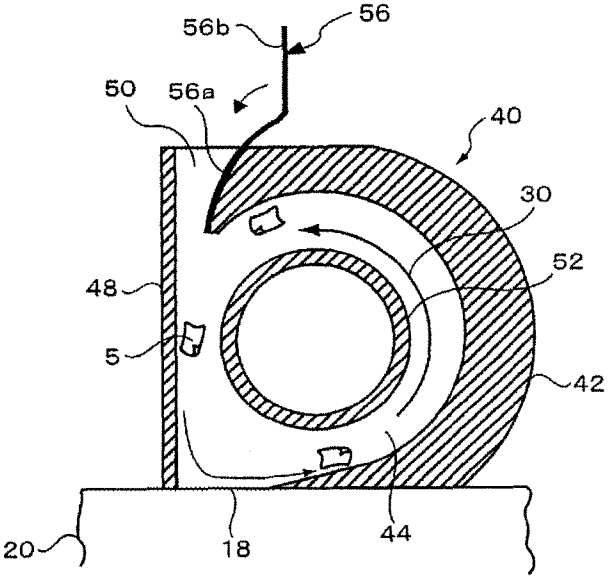
FIG. 1A is a view illustrating a state at a time of cleaning in a set of schematic vertical sectional views illustrating a dry type cleaning housing according to a first embodiment of the present invention.

FIG. 1A shows a state at a time of cleaning. In FIGS. 1A and 1B, the guide groove 44*c*, the porous structure of the separating plate 44, the suction opening 8, etc., are omitted.

For example, when cleaning is completed, so that the opening 18 is separated from the cleaning object 20, as shown in FIG. 1B, prior to a release operation, the pinching portion 56*b* of the revolving air flow adjusting plate 56 is held to push it downwards. In this way, the revolving flow path is blocked by the flow path blocking portion 56*a*.

When the revolving flow path is blocked, the revolving air flow 30 stops completely. Due to inertia of flight energy by the revolving air flow 30, the cleaning medium 5 gathers and stays at a retention space 58. The retention space 58 is a space to be also called a cleaning medium scavenging space that is formed between the flow path restricting member 52 and the flow path blocking portion 56*a* of the revolving air flow adjusting plate 56.

The retention space 58 according to the present embodiment is located on the downstream side in the revolving direction relative to a perpendicular line S which passes through a revolving axis center P at an upper portion of an inner space (a revolving flow path) which is sectioned by the flow path restricting member 52 and inside of the housing body 42, so that the cleaning medium 5 stays in the retention space 58 due to gravity.

In this state, the opening 18 is separated from the cleaning object 20. As a suction pressure is generated from the opening and the inlet to the separating plate within the housing, the cleaning medium is adhered to inside of the housing, so that it does not scatter from the opening or the inlet.

Moreover, when a porous flow path restricting member is used, suction from the central portion is added, so that the cleaning medium is adhered to both the flow path restricting member and the separating plate, so that it does not drop or scatter.

In this way, the revolving air flow adjusting plate 56 may be closed at the time of release or at the time of non-cleaning to completely prevent leakage of the cleaning medium.

The present embodiment with a configuration which allows holding the cleaning medium 5 in the retention space 58 by gravity makes it possible to hold the cleaning medium 5 within the housing without the suction effect unless the housing is turned upside down.

Removed matters by cleaning and debris of the cleaning medium 5 passes through the holes of the separating plate 44 to be collected on the suction unit side. Therefore, the cleaning medium 5 which accumulates in the retention space 58 is a cleaning medium which can be reused.

When starting or resuming cleaning, the cleaning medium 5 is suction cast into the housing from the opening 18 or the inlet 50 in suction ON state, the revolving air flow adjusting plate 56 is pulled up, so that the revolving flow path is opened.

In this way, the revolving air flow 30 is generated, so that cleaning is started.

The opening 18 may be placed on the cleaning object 20 to pull up the revolving air flow adjusting plate 56 to generate the revolving air flow 30 and cast the cleaning medium 5 from the inlet 50.

Alternatively, various methods may be adopted, such as, in suction OFF state, the opening 18 is placed on the cleaning object 20 to pull up the revolving air flow adjusting plate 56 to cast the cleaning medium 5 from the inlet 50, after which the revolving air flow 30 is generated in suction ON state, etc.

While the present embodiment is arranged to have the revolving air flow adjusting plate 56 operated manually, it may be arranged for it to be opened and closed with a drive unit which allows a mono-axial operation. The drive unit is desirably an air pressure driven or electrically driven cylinder or solenoid for reducing the size thereof.

While an arrangement position of the revolving air flow adjusting plate 56 is not particularly limited as long as it is a position at which the revolving flow path may be blocked, a configuration is which arrangement is performed by utilizing a face which makes up the inlet is ideal without undermining sealability of interference with other members.

Experimental results on a relationship between presence/absence of the revolving air flow adjusting plate 56 and a leakage rate of the cleaning medium at a time of release are shown in Table 1.

TABLE 1

| | CLEANING MEDIUM THICKNESS ~0.1 mm | CLEANING MEDIUM THICKNESS 0.1 mm~ |
|---|---|---|
| WITHOUT REVOLVING FLOW ADJUSTING UNIT | MEDIUM | POOR |
| WITH REVOLVING FLOW ADJUSTING UNIT | GOOD | GOOD |

REMARKS:
GOOD: NONE
MEDIUM: LESS THAN 5% OF ALL CLEANING MEDIA
POOR: LESS THAN 25% OF ALL CLEANING MEDIA

The leakage of the cleaning medium at the time of release or at the time of non-cleaning depends on a shape of the cleaning medium, so that, at a thickness of below 0.1 mm, the leakage of the cleaning medium is quite small even when there is no revolving flow adjusting unit, while, at a thickness of above 0.1 mm, the leakage of the cleaning medium becomes large.

On the other hand, with the revolving air flow adjusting plate 56, any cleaning medium could completely be prevented from leaking.

While the present embodiment is arranged to completely block the blocking flow path to stop the revolving air flow 30, the spirit of the present invention is not for it to be limited thereto. The spirit of the present invention is to suppress generation of unnecessary revolving air flow and reverse revolving air flow at the time of release or at the time of non-cleaning to prevent leakage of the cleaning medium from the opening 18 or the inlet 50.

Therefore, it includes reducing or attenuating to a level at which leakage may be prevented without completely stopping the revolving air flow 30.

From this viewpoint, it may be an operation which makes a cross-sectional area of the revolving flow path narrow by the revolving air flow adjusting plate 56.

Moreover, the flow path blocking portion 56*a* of the revolving air flow adjusting plate 56 may be made a porous member. In this case, a size of a hole is set such that a reverse revolving air flow is not generated.

According to the present embodiment, as shown in FIG. 1B, the opening 18 is arranged such that a position thereof is displaced to the left side shown on a horizontal face on the side which opposes the inlet 50 from a position on a perpendicular line S which passes through a revolving axis center P in a radial direction of the revolving air flow 30. Moreover, described more specifically, an angle (an inlet angle) formed between a proceeding direction of outer air which flows in from the inlet 50 and a face on which the opening 18 is in contact with the cleaning object is generally 90°.

The inlet 50 is formed such that the side thereof into which outer air flows is widely opened, and it gradually becomes narrow towards the opening 18 side. In other words, it is arranged to have a cross section narrowed towards the opening 18 side to increase a speed of air flow flowing in.

Moreover, a lower end of the front cover 48 defines one side of the opening 18 and is adjacent to the opening 18.

A size of the opening 18 is appropriately determined such that outer air may flow into the housing from the opening due to a negative pressure by suction at the time of release or at the time of non-cleaning or a shape of the cleaning object.

A position of the opening 18 is arranged at a position which deviates to the inlet side, so that a distance between the inlet 50 and the opening 18 becomes a shortest distance.

In this way, the cleaning medium 5 which flies in a revolving manner with the revolving air flow 30 is accelerated in a vertical direction with a high speed flow due to outer air flowing in from the inlet 50 to collide with the cleaning object 20 as it is. The cleaning medium 5 after colliding rides on the revolving air flow 30 and again reaches a region of the high speed air flow of the inlet 50, which cleaning operation is repeated.

The cleaning medium 5 flies with energy of the high speed air flow which flows in from the inlet 50 and collides with the cleaning object with no time to reduce speed, so that a collision energy efficiency is high and a cleaning efficiency is good.

A cleaning capability is highest when an inlet angle is 90°. Therefore, a cleaning efficiency is good as the collision energy of the cleaning medium which is accelerated by the inlet portion is not divided into components.

In other words, this is because a degree in which energy of high speed air flow which flows in from the inlet 50 mixes with revolving air flow to attenuate is low, so that most thereof is efficiently used as collision energy of the cleaning medium 5.

A second embodiment is described based on FIGS. 5A, 5B, 6A, and 6B. The same parts as the above-described, embodiment are shown with the same letters and, unless particularly necessary, explanations of configurations and functions already given are omitted, so that only major parts are explained. (The same applies to other embodiments below.)

The revolving air flow adjusting unit according to the present embodiment is made up of a flap 60 which is provided on an inner face of a front cover 48 which makes up a wall face of the revolving flow path to rotate freely in upward and downward directions by having one end thereof supported by a hinge structure. The hinge is provided within a thickness portion of the front over 48.

Figure 5B:
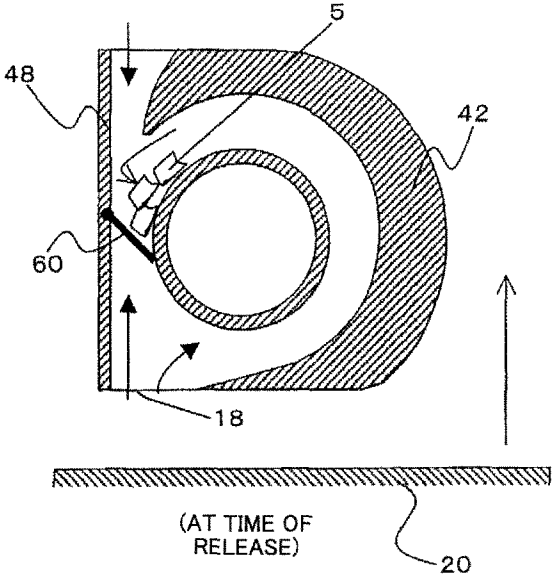
FIG. 5B is a view illustrating the state at a time of release in the set of schematic vertical sectional views illustrating the dry type cleaning housing according to the second embodiment of the present invention.
Figure 5A:
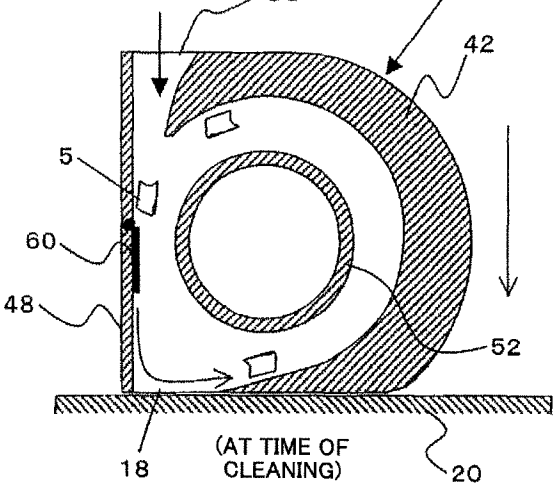
FIG. 5A is a view illustrating the state at the time of cleaning in the set of schematic vertical sectional views illustrating the dry type cleaning housing according to a second embodiment of the present invention.

When the pressure does not act, as shown in FIG. 5A, the flap 60 hangs down along an inner face of the front cover 48 due to its own weight.

When the opening 18 is separated from the cleaning object 20, as shown in FIG. 5B, as outer air flows in from the opening 18, the flap 60 is pushed up with a suction pressure via the flow path restricting member 52 and a pressure due to the flowing in air flow, so that it rotationally moves upwards, or, in other words, it topples in the flow path restricting member 52 direction, a free end thereof abuts against the flow path restricting member 52 and blocks the revolving flow path. In this way, the revolving air flow 30 stops.

At the time of release or at the time of non-cleaning, outer air flows in from the opening in addition to the inlet portion, so that pressure of the revolving flow path within the housing does not increase, being in a state in which the revolving air flow is weakened. In this state, a suction pressure onto the flow path restricting member 52 relatively exceeds a pressure due to the revolving air flow, so that the flap 60 is attracted to the flow path restricting member 52. In this way, the revolving flow path is closed, the revolving air flow stops completely, making it possible to completely prevent leakage of the cleaning medium.

In the same manner as the above-described embodiment, the cleaning medium 5 accumulates in the retention space which is formed between the flap 60 and the flow path restricting member 52.

At the time of cleaning the opening is blocked with the cleaning object, outer air flows in only from the inlet portion, a pressure of the revolving flow path within the housing increases, so that a revolving air flow is generated. In this state, the pressure due to the revolving air flow relatively exceeds a suction pressure to the flow path restricting member, so that the flap 60 is pushed against a wall face of the revolving flow path. In this way, the revolving air flow path is opened and the revolving air flow is generated, so that cleaning is started.

According to the present embodiment, the flap 60 automatically opens and closes due to a negative pressure difference between a time of cleaning and a time of non-cleaning, making it possible to ensure preventing leakage of the cleaning medium based on the fact that the revolving air flow adjusting unit is not operated due to forgetting or lack of attention by the operator.

Figure 6A:
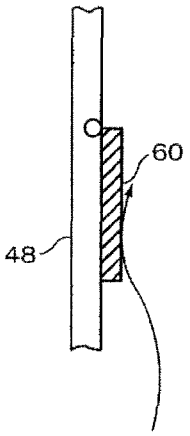
FIGS. 6A and 6B are views illustrating a configuration for facilitating rotational movement of a flap.

As shown in FIG. 6A, there is a concern that the flap 60 could be pushed against the wall face, not moving rotationally due to an air flow which flows in from the opening 18 at the time of release or at the time of non-cleaning.

Figure 6B:
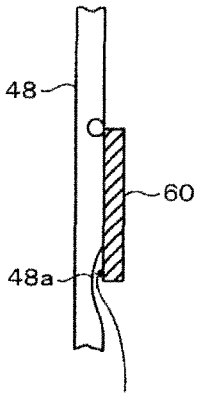

As an example of overcoming this concern, as shown in FIG. 6B, an air flow flow-in concave portion 48*a* may be formed for erecting the free end of the flap 60 in the vicinity of the free end in a state in which the flap 60 hangs down.

Figure 7:
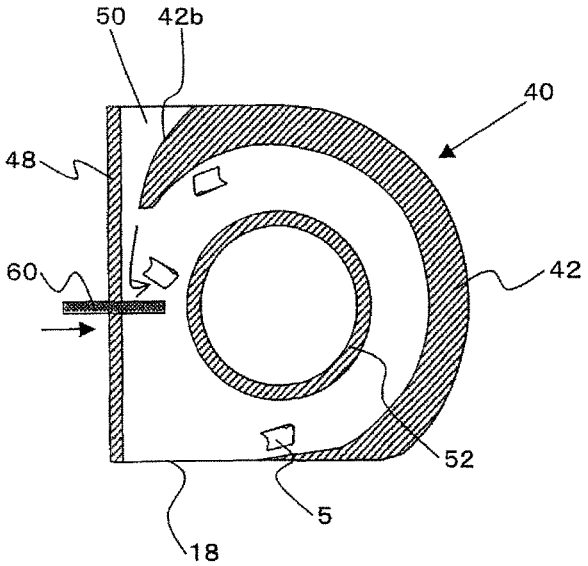
FIG. 7 is a schematic vertical cross sectional view of the dry type cleaning housing according to a third embodiment of the present invention.

A third embodiment is shown in FIG. 7.

While a configuration in which a revolving air flow adjusting unit is provided in a region of the inlet 50 to forcefully change a cross-sectional area of the revolving flow path is exemplified in the first embodiment, the present embodiment is a different example of an arrangement position of the revolving air flow adjusting unit.

As shown in FIG. 7, a shielding plate 62, which is a revolving air flow adjusting unit according to the present embodiment as a moving member, is movably provided in a generally horizontal direction, penetrating the front cover 48.

Before releasing, an operator pushes in the shielding plate 62 towards an arrow direction and abuts a tip thereof against the flow path restricting member 52. In this way, the revolving flow path is closed, the revolving air flow stops completely, making it possible to completely prevent leakage of the cleaning medium.

In a manner similar to the first embodiment, it may be arranged as an electrically driven scheme in which opening and closing are performed by a drive unit which allows a mono-axial operation.

Figure 8A:
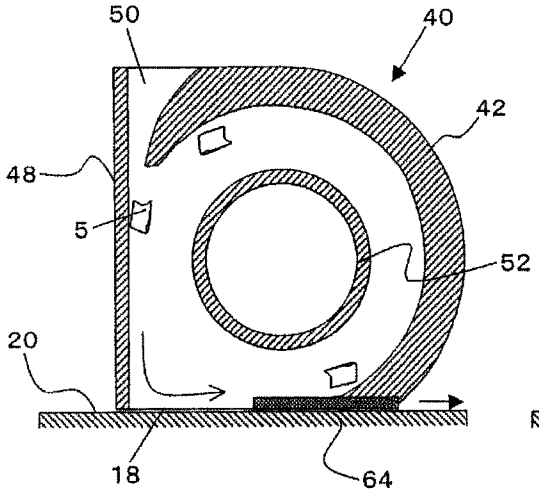
FIG. 8A is a view illustrating the state at the time of cleaning in the set of schematic vertical sectional views illustrating the dry type cleaning housing according to a fourth embodiment of the present invention.
Figure 8B:
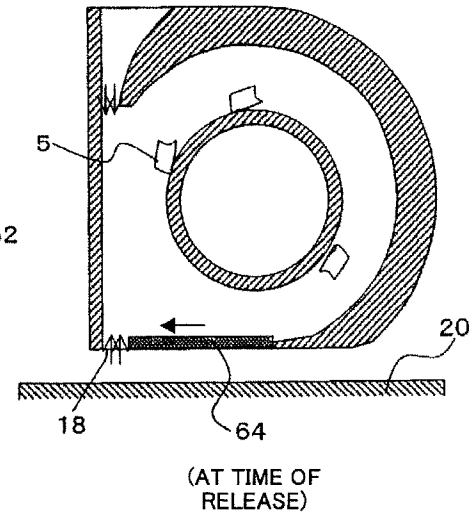
FIG. 8B is a view illustrating the state at a time of release in the set of schematic vertical sectional views illustrating the dry type cleaning housing according to the fourth embodiment of the present invention.

A fourth embodiment is shown in FIGS. 8A and 8B.

While the respective embodiments described above are arranged such that the revolving air flow adjusting unit changes a cross-sectional area of the revolving flow path to decrease or stop the revolving air flow, an amount of air which flows in from the opening 18 is adjusted to provide a balance with an amount of air which flows in from the inlet 50 to decrease or stop revolving air flow energy in the present embodiment.

In other words, it arranged for air flow which flows in from the opening 18 and air flow which flows in from the inlet 50 to cancel out, suppressing maintenance or generation of the revolving air flow due to either one of air flow exceeding the other.

The shielding plate 64, which is a revolving air flow adjusting unit for changing an opening area of the opening 18 and a movable member, is incorporated in a bottom face on the side of the opening 18 of the housing body 42, such that the shielding plate 64 is slidable in left and right directions shown while it is in close contact with the bottom face.

When the shielding plate 64 is caused to slide with a lever (not shown) to close it until an opening cross-sectional area becomes equal to a cross sectional area of the inlet portion before separating the opening 18 from the cleaning object 20 after completing cleaning, as an amount of outer air flowing in from the inlet 50 and an amount of outer air flowing in from the opening 18 becomes equal, both cancel each other, so that the revolving air flow stops completely.

As there is suction form the separating plate 44, a suction pressure from the opening or the inlet to the separating plate within the housing is generated, so that the cleaning medium does not scatter out from the opening or the inlet. Moreover, when the porous flow path restricting member 52 is used, as suction from the central portion is added, the cleaning medium is adhered to both the flow path restricting member and the separating plate, so that it does not drop or scatter.

Therefore, as shown in FIG. 8B, the shielding plate 64 may be closed at the time of release or at the time of non-cleaning to completely prevent leakage of the cleaning medium. As shown in FIG. 8A, as the shielding plate is opened at the time of cleaning, revolving air flow is generated, so that cleaning is started.

Completely closing the shielding plate 64 leads to the same state as a state at the time of cleaning, causing the cleaning medium to repeat colliding with the shielding plate and facilitating erosion of the cleaning medium. Moreover, after the cleaning medium collides with the shielding plate 64, some of the cleaning media bounces to the inlet side, again making it not possible to completely prevent leakage of the cleaning medium.

Therefore, in a sliding operation of the shielding plate 64, stopper (not shown) is provided for stopping the shielding plate 64 at a position at which the revolving air flow stops completely. In this way, the shielding plate 64 may be set at a predetermined position uniformly without relying on intuition of the operator.

While it is also effective to have cross-sectional areas of the inlet portion and the opening equal in an initial design, the cross-sectional area of the inlet portion is basically set to be small in order to increase a revolving flow speed. Therefore, the opening ends up narrow as a result, causing a decreased cleaning efficiency. It is effective only when such a shortcoming is tolerated.

While it is arranged to open and close manually in the present embodiment, in a manner similar to the first embodiment, it may also be arranged as an electrically driven scheme in which opening and closing are performed by a drive unit which allows a mono-axial operation.

Figure 9B:
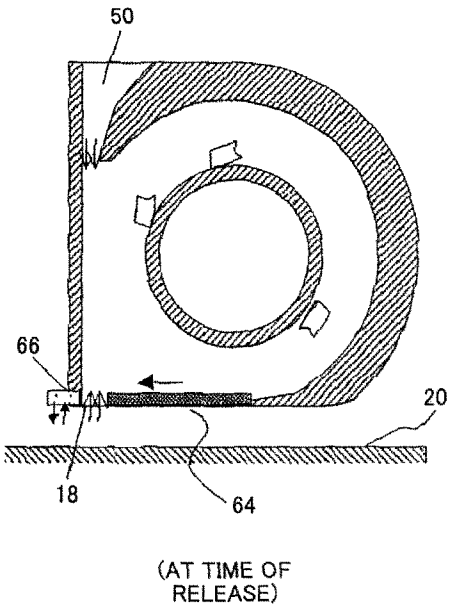
FIG. 9B is a view illustrating the state at a time of release in the set of schematic vertical sectional views illustrating the dry type cleaning housing according to the fifth embodiment of the present invention.
Figure 9A:
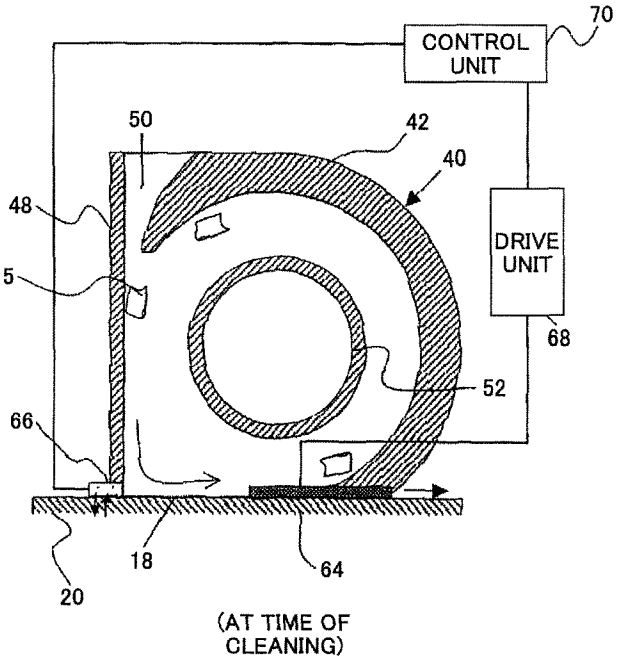
FIG. 9A is a view illustrating the state at the time cleaning in the set of schematic vertical sectional views illustrating the dry type cleaning housing according to a fifth embodiment of the present invention.

A fifth embodiment is shown in FIGS. 9A and 9B.

While the electrically driven scheme in the configuration shown in FIGS. 8A and 8B is operated by an operator turning on a switch, it is completely automated in the present embodiment.

As shown in FIG. 9A, a contact sensor 66 is provided as a release detecting unit which detects a state of non-contact between the opening 18 and the cleaning object 20 or a state of being separated at a certain distance between the opening 18 and the cleaning object 20 is provided on a bottom face on the side of the opening 18 of the housing body 42, or, more specifically, at a lower end of the front cover 48 in proximity to the opening 18.

As the contact sensor 66, an optical sensor, a micro switch, etc., may be adopted.

The control unit 70 monitors where the housing and the cleaning object are in contact with each other or are located at a certain distance via the contact sensor 66. When the housing and the cleaning object are in contact with each other or are located at the certain distance, it is determined to be at a time of cleaning, so that, as shown in FIG. 9A, the drive unit 68 is controlled to open the opening 18.

Conversely, when they are not in contact or when they are located at greater or equal to the certain distance, it is determined to be at a time of release or at a time of non-contact, so that, as shown in FIG. 9B, the drive unit 68 is controlled to block the opening 18 such that a cross-sectional area thereof becomes a predetermined cross-sectional area.

According to the present embodiment, the shielding plate 64 automatically opens and closes, making it possible to ensure preventing leakage of the cleaning medium based on the revolving air flow adjusting unit not being operated due to forgetting or lack of attention by the operator.

The present application is based on Japanese Priority Application No. 2011-271524 filed on Dec. 12, 2011, the entire contents of which are hereby incorporated by reference.

The invention claimed is:

1. A dry type cleaning housing which causes a cleaning medium to fly with an air flow and places the cleaning medium on a cleaning object to clean the cleaning object, comprising:

an inner space in which the cleaning medium flies;

an opening which abuts against the cleaning object so that the cleaning medium collides with the cleaning object;

a ventilation path which passes air from outside into the inner space;

a suction opening which suctions the air introduced into the inner space via the ventilation path to generate a revolving air flow in the inner space;

a porous unit which passes a substance removed from the cleaning object to a suction opening side; and a revolving air flow adjusting unit which arbitrarily reduces or stops the revolving air flow by blocking a revolving flow path in which the revolving air flow revolves.

2. The dry type cleaning housing as claimed in claim 1, wherein the revolving air flow adjusting unit is configured to change a cross-sectional area of the revolving flow path in which the revolving air flow revolves.

3. The dry type cleaning housing as claimed in claim 2, wherein the revolving air flow adjusting unit is configured to form a retention space between the revolving air flow adjusting unit and an inner portion of the housing such that the cleaning medium accumulates in the retention space when the revolving air flow is stopped; and a position at which the retention space is formed is a position at which the cleaning medium is held to the retention space by gravity.

4. The dry type cleaning housing as claimed in claim 3, wherein the revolving air flow adjusting unit is slidably provided along a face which makes up the ventilation path.

5. The dry type cleaning housing as claimed in claim 2, wherein the revolving air flow adjusting unit is provided on a wall face of the revolving flow path and one end of the revolving air flow adjusting unit is supported by the wall face to permit the revolving air flow adjusting unit to move rotationally in the upward and downward directions, wherein the revolving air flow adjusting unit operates due to a difference in negative pressure at a time of cleaning and at a time of non-cleaning.

6. The dry type cleaning housing as claimed in claim 1, wherein the revolving air flow adjusting unit is configured to set an amount of air flowing in from the opening equivalent to an amount of air flowing in from the ventilation path.

7. A dry type cleaning apparatus, comprising:

the dry type cleaning housing as claimed in claim 1; and a suction unit which is connected to the suction opening.

8. The dry type cleaning housing as claimed in claim 1, wherein the revolving air flow adjusting unit includes a movable member which changes an opening area of the opening.

9. A dry type cleaning housing which causes a cleaning medium to fly with an air flow and places the cleaning medium on a cleaning object to clean the cleaning object, comprising:

an inner space in which the cleaning medium flies;

an opening which abuts against the cleaning object so that the cleaning medium collides with the cleaning object;

a ventilation path which passes air from outside into the inner space;

a suction opening which suctions the air introduced into the inner space via the ventilation path to generate a revolving air flow in the inner space;

a porous unit which passes a substance removed from the cleaning object to a suction opening side; and a revolving air flow adjusting unit which arbitrarily reduces or stops the revolving air flow, wherein the revolving air flow adjusting unit includes a movable member which changes an opening area of the opening.

10. The dry type cleaning housing as claimed in claim 9, further comprising:

a drive unit which operates the movable member such that the amount of air flowing in from the opening becomes equivalent to the amount of air flowing in from the ventilation path.

11. The dry type cleaning housing as claimed in claim 10, further comprising:

a release detecting unit which detects a state in which the opening is not in contact with the cleaning object or a state in which the opening is separated from the cleaning object at a certain distance, wherein the movable member is operated by the drive unit when it is determined by the release detecting unit to be a time of release.

12. A dry type cleaning apparatus, comprising:

the dry type cleaning housing as claimed in claim 9; and a suction unit which is connected to the suction opening.

* * * * *